United States Patent [19]

Kato

[11] 4,248,677

[45] Feb. 3, 1981

[54] PROCESS FOR PRODUCING ALPHA-AMINOCARBOXYLIC ACIDS AND SALTS THEREOF

[75] Inventor: Shozo Kato, Tokuyama, Japan

[73] Assignee: Tokuyama Soda Kabushiki Kaisha, Yamaguchi, Japan

[21] Appl. No.: 56,187

[22] Filed: Jul. 10, 1979

[30] Foreign Application Priority Data

Jul. 10, 1978 [JP] Japan ..... 53-82916
Jul. 18, 1978 [JP] Japan ..... 53-86694

[51] Int. Cl.[3] ..... C25B 3/00; C25B 3/10

[52] U.S. Cl. ..... 204/59 R; 562/440; 562/442; 562/560; 562/574; 562/575

[58] Field of Search ..... 204/59 R; 562/440, 442, 562/560, 574, 575

[56] References Cited

U.S. PATENT DOCUMENTS

| | | | |
|---|---|---|---|
| 3,790,598 | 2/1974 | Damico et al. | 562/560 X |
| 4,018,844 | 4/1977 | Meresz et al. | 204/59 R X |
| 4,032,676 | 6/1977 | Heins et al. | 562/560 X |
| 4,065,495 | 12/1977 | Umezawa et al. | 562/560 |
| 4,072,583 | 2/1978 | Hallcher et al. | 204/59 R |

*Primary Examiner*—Arthur C. Prescott
*Attorney, Agent, or Firm*—Sherman & Shalloway

[57] ABSTRACT

This invention relates to a process for producing alpha-aminocarboxylic acids and salts thereof. More specifically, this invention relates to a process for producing alpha-aminocarboxylic acids or salts thereof from organic imine compounds by electrochemical reduction.

12 Claims, No Drawings

PROCESS FOR PRODUCING ALPHA-AMINOCARBOXYLIC ACIDS AND SALTS THEREOF

BRIEF SUMMARY OF DISCLOSURE

A process for producing alpha-aminocarboxylic acids of the following formula

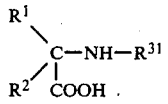

(II)

wherein $R^1$ and $R^2$ are the same or different, and represent a hydrogen atom, or a substituted or unsubstituted alkyl, alkenyl or aryl group, and $R^1$ and $R^2$ do not represent hydrogen atoms at the same time, $R^{31}$ represents a substituted or unsubstituted alkyl, alkenyl or aryl group; or a hydrogen atom or a group of the following formula

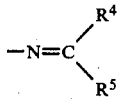

(a')

in which $R^4$ and $R^5$ are identical or different and have the same definitions as $R^1$ and $R^2$ above, when n in $R^3$ of formula (I) given hereinbelow is 0; or a group of the following formula

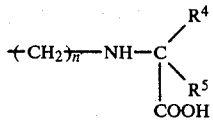

(b)

in which n' is an integer of at least 2 and $R^4$ and $R^5$ are as defined above, when n in $R^3$ of formula (I) given hereinbelow is an integer of at least 2;

or salts thereof, which comprises subjecting an organic imine compound of the following formula

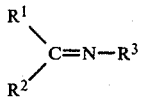

(I)

wherein $R^1$ and $R^2$ are as defined above, and $R^3$ represents a substituted or unsubstituted alkyl, alkenyl or aryl group, or a group of the following formula

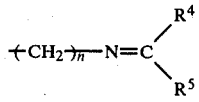

(a)

in which $R^4$ and $R^5$ are identical or different, and have the same definitions as $R^1$ and $R^2$, and n is 0 or an integer of at least 2, and carbon dioxide to electrochemical reduction and addition reaction in an aprotic polar organic medium in the substantial absence of water, and subsequent reaction of the resulting active carboxylated anion species with a proton donor, and if desired, subjecting the product to a salt conversion reaction.

Alpha-aminocarboxylic acids include various useful compounds which find a wide range of applications. Some of them are useful as essential amino acids, and some other are known to be used as materials for pharmaceuticals (for example, U.S. Pat. Nos. 3,299,095, 3,306,909, and 3,361,626), or as stabilizers for polymer (for example, U.S. Pat. No. 2,525,643).

Known methods for producing alpha-aminocarboxylic acids include the following.

(1) A method comprising reacting a benzaldehyde derivative with sodium cyanide or potassium cyanide in the presence of an amine or a mineral acid salt of an amine, and hydrolyzing the resulting aminonitrile derivative (Strecker Amino Acid Synthesis), and (2) a method comprising brominating phenylacetic acid or its amide, ester, nitrile, etc., and reacting the resulting alpha-bromophenylacetic acid derivative with an amine.

Since the method (1) uses extremely poisonous cyanides, it inevitably has serious defects in reaction operation and in the treatment of wastes. It further has the defect that a considerable amount of a tarry material is formed as a by-product upon hydrolysis. In the method (2), the lachrymatic properties of the phenylacetic acid derivatives, and the toxicity of bromine and its difficulty in handling pose a problem.

It was reported that an amino acid of the following formula

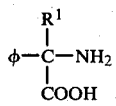

wherein $R^1$ represents hydrogen or methyl, and $\phi$ represents phenyl, was obtained in a good yield of 40 to 90% by electrochemically reducing a Schiff base of the following formula

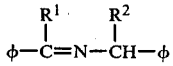

wherein $R^1$ and $\phi$ are as defined, and $R^2$ represents hydrogen, methyl or ethyl, in the presence of carbon dioxide using nonaqueous solvent-quaternary amine salt-mercury cathode, and subsequently catalytically reducing the electrolyzed solution with a Pd-C catalyst (Preprints of Speeches I, page 715, 31st Annual Autumn Meeting, the Chemical Society of Japan).

This report only describes the production of free phenylglycines by catalytic reduction, and does not refer to reactions with proton donors and the production of N-substituted phenylglycines.

The above report also describes a method of synthesizing phenylglycine from ammonia or hydrazine, carbon dioxide gas and benzaldehyde by electrolysis. However, the report does not describe any details of the results of this synthetic method at all.

Investigations of the present inventor have shown that when the electrochemical reduction is carried out in the presence of water, the yield of the desired alphaaminocarboxylic acid is extremely decreased. Accordingly, in the above-cited method of producing phenylglycine by electrochemical reduction of ammonia or hydrazine, carbon dioxide gas and benzaldehyde, the water formed within the reaction system induces side-reactions to give an amine as a by-product, and a decrease in the yield of the desired phenylglycine is unavoidable.

It is an object of this invention to provide a process for producing alpha-aminocarboxylic acids in high yields at low costs from organic imine compounds and carbon dioxide by electrochemical reduction and reaction with proton donors.

Another object of this invention is to provide a process for producing N-substituted alpha-aminocarboxylic acids in high yields at low costs from Schiff bases, which are organic imine compounds, and carbon dioxide by electrochemical reduction and reaction with proton donors.

Still another object of this invention is to provide a process for producing N-substituted alpha-aminocarboxylic acids and/or N-unsubstituted alpha-aminocarboxylic acids in high yields at low costs from azines, which are organic imine compounds, and carbon dioxide by electrochemical reduction and reaction with proton donors.

Further objects of the invention along with its advantages will become apparent from the following description.

These objects and advantages of the invention are achieved by a process for producing alpha-aminocarboxylic acids of the following formula

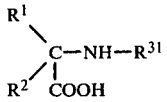

(II)

wherein $R^1$ and $R^2$ are the same or different, and represent a hydrogen atom, or a substituted or unsubstituted alkyl, alkenyl or aryl group, and $R^1$ and $R^2$ do not represent hydrogen atoms at the same time, and $R^{31}$ represents a substituted or unsubstituted alkyl, alkenyl or aryl group; or $R^{31}$ represents a hydrogen atom or a group of the following formula

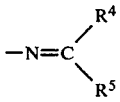

(a')

in which $R^4$ and $R^5$ are identical or different and have the same definitions as $R^1$ and $R^2$ above, when n in $R^3$ of formula (I) given hereinbelow is 0; or a group of the following formula

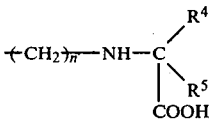

(b)

in which n' is an integer of at least 2 and $R^4$ and $R^5$ are as defined above, when n in $R^3$ of formula (I) given hereinbelow is an integer of at least 2; or salts thereof, which comprises subjecting an organic imine compound of the following formula

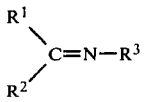

(I)

wherein $R^1$ and $R^2$ are as defined above, and $R^3$ represents a substituted or unsubstituted alkyl, alkenyl or aryl group, or a group of the following formula

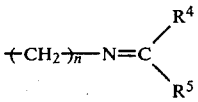

(a)

in which $R^4$ and $R^5$ are identical or different, and have the same definitions as $R^1$ and $R^2$, and n is 0 or an integer of at least 2, and carbon dioxide to electrochemical reduction and addition reaction in an aprotic polar organic medium in the substantial absence of water, and subsequent reaction of the resulting active carboxylated anion species with a proton donor, and if desired, subjecting the product to a salt conversion reaction.

The organic imine compounds of formula (I) used in the process of this invention are classified into the following five groups according to the definition of $R^3$.

A first group of these compounds includes those in which $R^3$ in formula (I) represents a substituted or unsubstituted alkyl group. Such compounds are expressed by the following formula

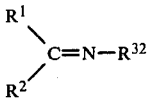

(I)-1 wherein $R^1$ and $R^2$ are the same as defined above with respect to formula (I), and $R^{32}$ represents a substituted or unsubstituted alkyl group.

A second group of these compounds includes those in which $R^3$ in formula (I) represents a substituted or unsubstituted alkenyl group. Such compounds are expressed by the following formula

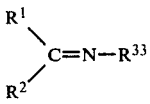

(I)-2 wherein $R^1$ and $R^2$ are the same as defined above with regard to formula (I), and $R^{33}$ represents a substituted or unsubstituted alkenyl group.

A third group of these compounds includes those in which $R^3$ in formula (I) represents a substituted or unsubstituted aryl group. Such compounds are expressed by the following formula

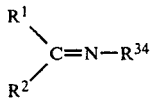

(I)-3 wherein $R^1$ and $R^2$ are the same as defined above with regard to formula (I), and $R^{34}$ represents a substituted or unsubstituted aryl group.

A fourth group of these compounds includes those in which $R^3$ in formula (I) is the group (a'). Such compounds are expressed by the following formula

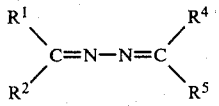

(I)-4 wherein $R^1$, $R^2$, $R^4$ and $R^5$ are as defined above with regard to formula (I).

A fifth group of these compounds includes those in which $R^3$ in formula (I) represents the group of formula (a) and n is an integer of at least 2. Such compounds are expressed by the following formula

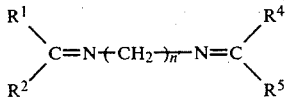

(I)-5 wherein $R^1$, $R^2$, $R^4$ and $R^5$ are the same as defined above with regard to formula (I), and n' is an integer of at least 2.

Among these five groups, the compounds of groups expressed by the formulae (I)-1, (I)-2, (I)-3, and (I)-4 are preferred. The compounds of formula (I)-1 in which $R^{32}$ represents substituted alkyl groups other than alpha-arylsubstituted alkyl groups, and the compounds of formulae (I)-2, (I)-3, and (I)-4 are more preferred. The compounds of formula (I)-3 are especially preferred. In the present application, the organic imine compounds of formula (I)-1, (I)-2, (I)-3 and (I)-5 are sometimes named "Schiff bases", and the organic imine compounds of formula (I)-4, "azines".

In the above formulae, $R^1$ and $R^2$ are identical or different, and represent a hydrogen atom, or a substituted or unsubstituted alkyl, alkenyl or aryl group. $R^1$ and $R^2$ do not represent hydrogen atoms at the same time. The substituted or unsubstituted alkyl or alkenyl group may be linear, branched or cyclic.

The unsubstituted alkyl group preferably has 1 to 24 carbon atoms, especially 3 to 18 carbon atoms. The cyclic alkyl group is preferably 5- or 6-membered. Specific examples of the alkyl group are linear or branched alkyl groups such as methyl, ethyl, n-propyl, isopropyl, n-butyl, sec-butyl, isobutyl, t-butyl, n-hexyl, n-heptyl, n-octyl, n-nonyl, n-decanyl, stearyl, tetradecanyl and octadecanyl; and cyclic alkyl groups such as cyclopentyl, cyclohexyl and cycloheptyl.

The unsubstituted alkenyl group may be linear, branched, or cyclic. The unsubstituted alkenyl group preferably has 2 to 24 carbon atoms, especially 3 to 18 carbon atoms. The cyclic alkenyl group preferably has 5 to 18 carbon atoms.

Examples of such alkenyl groups are linear or branched alkenyl groups such as vinyl, allyl, isopropenyl, 2-butenyl, 3-pentenyl, 6-heptenyl, and 9-decenyl; and cyclic alkenyl groups such as 1-cyclopentenyl, 2-cyclopentenyl, 3-cyclohexenyl, and 3-cycloheptenyl.

Phenyl and biphenyl are especially preferred as the unsubstituted aryl groups.

Examples of the substituents on the substituted alkyl or alkenyl group include halogen atoms such as fluorine, chlorine or bromine; a mercapto group; a dimethylamino group; arylthio groups such as phenylthio, alkylthio groups such as ethylthio; a hydroxyl group; a carboxyl group; an ester group such as methoxycarbonyl or ethoxycarbonyl; alkoxy groups such as methoxy or ethoxy; and aryl groups such as phenyl, tolyl or halophenyl.

These substituents are not split off during the electrochemical reduction in accordance with this invention. Or acidic protons may be split off from some of these substituents by the electrochemical reduction, but they are converted back to the original groups by the subsequent reaction with proton donors. Other groups than those exemplified above may be used equally as such substituents if they have such properties.

Substituents for the aryl group may be those which have been cited above as substituents for the alkyl or alkenyl groups. Other substituents for the aryl group include linear or branched alkyl groups such as methyl, ethyl, n-propyl, t-butyl, n-hexyl, n-octyl, and stearyl; and linear or branched alkenyl groups such as vinyl, allyl, isopropenyl and 9-decenyl.

Among the above-exemplified substituents, fluorine, chlorine, bromine, carboxyl, methoxy, ethoxy, methoxycarbonyl, and ethoxycarbonyl are especially preferred as substituents for the alkyl, alkenyl and aryl groups.

The number of such substituents introduced into groups $R^1$ and/or $R^2$ is at least 1. Two or more such substituents, which are identical or different, can be introduced, if necessary. Preferably, $R^1$ and $R^2$ contain only one of such substituents.

Thus, $R^1$ and $R^2$ in formula (I) preferably represent a hydrogen atom or a substituted or unsubstituted aryl group. It is especially preferred that one of $R^1$ and $R^2$ be a hydrogen atom, and the other, a substituted or unsubstituted aryl group.

In formula (I)-1, $R^{32}$ is a substituted or unsubstituted alkyl group. Examples of the unsubstituted alkyl group are those exemplified hereinabove with respect to $R^1$ and $R^2$. The substituted alkyl group should desirably not contain the substituent bonded to the carbon atom at the alpha-position. Preferably, it is an aryl-substituted alkyl group in which the aryl group is not bonded to the carbon atom at the alpha-position to the N atom. Accordingly, for example, it represents beta-phenylethyl, beta-(p-chlorophenyl)ethyl, or gamma-chloropropionyl. Examples of the substituent are those given above with regard to $R^1$ and $R^2$.

With compounds of formula (I) in which $R^3$ is an alpha-aryl-substituted alkyl group for example, benzylidene benzylamine, the yield of the corresponding alpha-aminocarboxylic acid such as N-benzylphenylglycine formed by electrochemical carboxylation and subsequent reaction with a proton donor, generally tends to be low. Furthermore, there is a marked difference in yield between the case of using a mercury cathode and the case of using a solid electrode such as a brass cathode. The reason for this is not entirely clear. But from the fact that a large amount of N,N'-disubstituted ethylenediamine is isolated, it is presumed that the anion species formed by electrochemical reduction dimerizes before it undergoes carboxylation.

In contrast, the above tendency is not observed when $R^3$ is an unsubstituted alkyl group, or a substituted alkyl group other than the alpha-aryl-substituted alkyl groups.

Examples of the substituted or unsubstituted alkenyl group represented by $R^{33}$ in formula (I)-2 are linear or branched alkenyl groups such as vinyl, allyl, isopropenyl, 2-butenyl, 3-pentenyl, 6-heptenyl and 9-decenyl, and cyclic alkenyl groups such as 1-cyclopentenyl, 2-cyclopentenyl, 3-cyclohexenyl and 3-cycloheptenyl.

Examples of the substituted or unsubstituted aryl group represented by $R^{34}$ in formula (I)-3 are unsubstituted aryl groups such as phenyl or biphenyl, and substituted aryl groups obtained by replacing one or more hydrogens on these aryl groups with the substituents exemplified hereinabove with regard to $R^1$ and $R^2$.

$R^4$ and $R^5$ in the above formulae (I)-4 and (I)-5 are the same as defined above for $R^1$ and $R^2$. Accordingly, examples of these groups are the same as those exemplified hereinabove for $R^1$ and $R^2$.

In the above formula (I)-5, n' is an integer of at least 2, preferably 2 to 18. Examples of the group $(CH_2)n'$ are ethylene, trimethylene, tetramethylene, pentamethylene, nonamethylene and pentadecamethylene.

The organic imine compounds of formula (I) used in this invention can be produced by known methods, for example the method described in Wagner & Zook, "Synthetic Organic Chemistry", page 728 et seq. (1953).

The process of this invention is performed first by subjecting the organic imine compound of formula (I) and carbon dioxide to electrochemical reduction and addition reaction in an aprotic polar organic solvent in the substantial absence of water.

The electrochemical reduction and the addition reaction may be carried out separately. It is possible, however, to perform the addition reaction while carrying out the electrochemical reduction.

Preferably, the addition reaction is carried out while performing the electrochemical reduction. In this case, a solution of the organic imine compound and carbon dioxide in the aprotic polar organic medium is subjected to an electrochemical reduction operation. In this case, the anion species of the organic imine compound formed in the reaction system by the electrochemical reduction reacts with carbon dioxide present in the same reaction system, or the anion species of carbon dioxide formed in the reaction system by the electrochemical reduction reacts with the organic imine compound present in the same reaction system.

Investigations of the present inventor have shown that when the organic imine compound is more reducible than carbon dioxide, the anion species of the organic imine compound is generally more readily formed than the anion species of carbon dioxide, and therefore that the reaction proceeds as in the former case mentioned above. On the other hand, when carbon dioxide is more reducible than the organic imine compound, the anion species of carbon dioxide is more readily formed than that of the organic imine compound, and therefore, the reaction is considered to proceed as in the latter case mentioned above.

Generally, organic imine compounds of formula (I), in which at least one of $R^1$ and $R^2$ is a substituted or unsubstituted aryl group are more reducible than carbon dioxide, and those in which $R^1$ and $R^2$ both represent groups other than the substituted or unsubstituted aryl group are less reducible than carbon dioxide.

As stated above, the electrochemical reduction and the addition reaction can be performed separately. In this embodiment, a solution of the organic imine compound in the aprotic polar organic medium is electrochemically reduced to form the anion species of the organic imine compound. Then, carbon dioxide is dissolved in the reaction mixture to react it with the anion species. Alternatively, a solution of carbon dioxide in the aprotic polar organic medium is electrochemically reduced to form the anion species of the carbon dioxide. Then, the organic imine compound is dissolved in the reaction mixture to react it with the anion species.

In the above process, dissolving of the organic imine compound in the aprotic polar organic medium is effected by adding the organic imine compound to the aprotic polar organic medium. Dissolving of carbon dioxide can be effected by blowing carbon dioxide into the aprotic polar organic medium, or putting dry ice into it. Or it can also be effected by putting a compound capable of generating carbon dioxide upon decomposition under the reaction conditions, particularly at the temperature of the reaction, into the aprotic polar organic medium.

The mechanism of the electrochemical reduction and the addition reaction in this invention is believed to be schematically shown as follows when benzylidene aniline is taken up as an example of the organic imine compound.

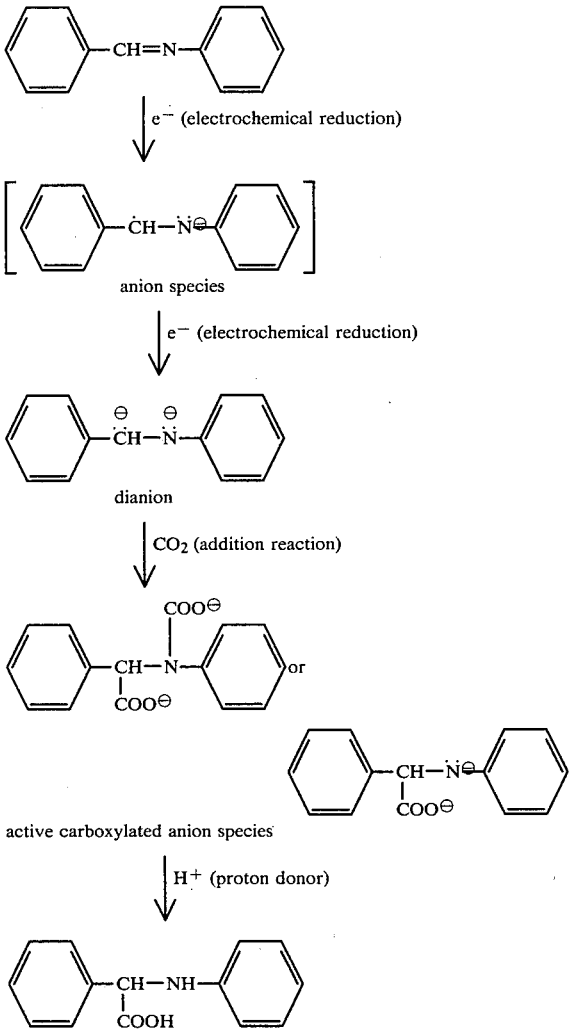

Examples of the suitable aprotic polar organic media used in the process of this invention include nitrile-type solvents such as acetonitrile, propionitrile and benzonitrile, carbamide-type solvents such as formamide and N,N-dimethylformamide; phosphoramide-type solvents such as hexamethylphosphoric triamide; and sulfoxide-type solvents such as dimethylsulfoxide.

These solvents can be used either alone or as a mixture. Preferred are those which are easy to dehydrate and to purify by distillation, have a low boiling point and are readily available. The nitrile-type solvents, above all acetonitrile, are especially preferred.

Other aprotic polar organic media may equally be used in this invention which do not undergo electrochemical reduction, or are not readily vulnerable to electrochemical reduction, under the electrochemical reduction conditions of this invention.

In the process of this invention, the aprotic polar organic medium is used in a substantially anhydrous condition. Dehydration procedures for the respective solvents are known, and for example, dehydration by molecular sieves, and distillation can be employed.

The electrochemical reduction in accordance with this invention does not need to be carried out in a special electrolytic cell, and can be carried out in known electrolytic cells. The electrode used in this process may be of any material which is not vulnerable to the electrochemical reduction conditions, and has sufficient electric conductivity. The cathode is preferably made of a solid material such as brass, graphite, inconel, copper, nichrome, zinc, lead, platinum, nickel, stainless steel and aluminum. Liquid material such as mercury can also be used.

The final product can be obtained generally in a higher yield when the electrochemical reduction is carried out using a solid cathode than when it is carried out using a liquid cathode. The former is advantageous because it will not cause pollution as in the case of a mercury electrode. A mercury cathode, however, has the advantage that the electrode surface can be always renewed during the electrolysis.

Materials for the anode are, for example, platinum and graphite.

The electrochemical reduction may be carried out by any of controlled current electrolysis, controlled voltage electrolysis and controlled potential electrolysis (three electrodes method) if it is possible to set conditions which effect the reduction of the organic imine compound or carbon dioxide.

Generally, the current density is at least about 0.1 $mA/cm^2$, preferably 0.5 to 50 $mA/cm^2$. Generally, the yield of the N-substituted phenylglycine tends to increase with increasing current density.

Conveniently, the electrochemical reduction is carried out generally at room temperature. The temperature, however, is not critical, and no particular trouble will occur if it is above the freezing point up to the boiling point of the solvent. Conveniently, the reaction pressure is atmospheric pressure in an atmosphere of carbon dioxide. The reaction may also be carried out at an elevated pressure in an atmosphere of carbon dioxide or an inert gas which is not cathodically reduced in the presence of carbon dioxide. Desirably, the electrolytic solution is stirred. When the electrolysis is carried out while blowing carbon dioxide or other inert gases into the electrolytic solution, stirring of the solution caused by the blowing is sometimes sufficient.

To increase the electric conductivity of the electrolytic solution, it is preferable to add an electrolyte which is soluble in the aprotic polar organic solvent and is not reduced, or is difficult to reduce, under the electrolytic conditions. Known materials can be used as the electrolyte. Generally, it is advisable to select those electrolytes which can be easily separated from the electrochemical reduction product. For example, tetraalkylammonium salts of the following formula $$(R^6)_4N^{\oplus}.X^{\ominus}$$

wherein $R^6$ represents an alkyl group having 1 to 6 carbon atoms, and $X^{\ominus}$ represents an anion, are preferred as the electrolyte.

Examples of $R^6$ in the above formula are methyl, ethyl, propyl, butyl, pentyl and hexyl. Examples of $X^-$ are halogens such as chlorine, bromine or iodine, $OH^-$, $OSO_3CH_3^-$, $BF_4^-$, $ClO_4^-$, $OSO_2—C_6H_5^-$, $OSO_2—C_6H_4CH_3^-$, $\frac{1}{2}SO_4^{2-}$, and $\frac{1}{2}CO_3^{2-}$.

Most preferred are tetraalkylammonium halides, especially tetraethylammonium iodide. Phosphonium salts such as tetraphenylphosphonium tetrafluoroborate, and compounds not vulnerable to reduction under the electrolytic conditions, such as magnesium perchlorate, can also be used as the electrolyte.

The electrolyte is used in an amount sufficient to carboxylate the organic imine compound electrochemically. It is usually dissolved in the electrolytic solution in a concentration of 1 to 30% by weight.

In performing the electrolytic reduction, a sieve-like glass diaphragm of suitable coarseness may be used to partition the electrolytic cell into cathode and anode compartments. When the yield of the product and the current efficiency are likely to be reduced by substance migration, the cell is divided preferably with a cation exchange membrane.

When the organic imine compound of formula (I) contains a proton donating group such as a carboxyl or hydroxyl group as a substituent in the molecule, it is desirable to reduce the proton to hydrogen gas by preliminary electrolysis of the compound at a lower potential or a lower current density than those used in performing the electrochemical reduction in accordance with this invention, or to convert the proton donating group to a salt such as a tetraethylammonium salt prior to the electrochemical reduction in accordance with this invention.

When a solution of the organic imine compound and carbon dioxide in the aprotic polar organic medium is used as the electrolytic solution in the electrochemical reduction in accordance with this invention, addition reaction proceeds simultaneously with the electrochemical reduction, thereby to form an active carboxylated anion species.

When a solution of either one of the organic imine compound and carbon dioxide is used in the electrochemical reduction, it is possible to perform addition reaction by dissolving the other of the above compounds in the reaction mixture resulting from the electrochemical reduction, and thereby to generate an active carboxylated anion species. The temperature, pressure and atmosphere, etc. for the addition reaction are properly selected within the ranges of the conditions for the electrochemical reduction.

According to this invention, the active carboxylated anion species in the reaction mixture obtained by the electrochemical reduction and addition reaction is then reacted with a proton donor, and if desired, the product is further subjected to a salt conversion reaction.

The active carboxylated anion species easily reacts with the proton donor upon contact with it. Accordingly, the reaction between the active carboxylated anion species and the proton donor is carried out by adding the proton donor to the reaction mixture containing the active carboxylated anion species, or first removing a part or the whole of the reaction medium from the reaction mixture and then adding the proton donor. Or when the active carboxylated anion species is insoluble in the reaction medium, it is separated by filtration, and then contacted with the proton donor.

The proton donor is preferably water, a mineral acid, an organic acid, or an aqueous solution of such an acid. Suitable mineral acids include, for example, hydrochloric acid, sulfuric acid and phosphoric acid, and suitable organic acids include, for example, acetic acid, oxalic acid, and formic acid. Among them, hydrochloric acid is especially preferred.

Accordingly, the reaction with the proton donor in this invention can be performed as a post-treating procedure to isolate the reaction product obtained by the electrochemical reduction and addition reaction.

For example, the solvent is removed by distillation after the electrochemical reduction and the addition reaction. Water is added to the residue, and it is extracted with a water-immiscible solvent such as chloroform, benzene or diethyl ether. When the addition of water causes precipitation of the desired alpha-aminocarboxylic acid as a solid, the alpha-aminocarboxylic acid can be isolated simply by filtering the mixture. When the alpha-aminocarboxylic acid does not precipitate by the addition of water, the aforesaid solvent extraction is carried out and the resulting alkaline aqueous layer is neutralized or rendered weakly acidic (pH 2–6) to isolate the alpha-aminocarboxylic acid. In most cases, the resulting alpha-aminocarboxylic acid is pure. If further purification is required, it is recrystallized from a proper solvent such as alcohol or ethyl acetate.

When the organic imine compounds of formulae (I)-1, (I)-2, (I)-3, and (I)-5 are used as the starting material, it is recommended to perform the reaction with the proton donor and to isolate the product in the following manner.

After the electrolysis, the solvent is removed by distillation, and water is added to the distillation residue. The oily or solid secondary amine derivative is extracted with a solvent which is not miscible with water and well dissolves the secondary amine derivative, such as benzene, chloroform and diethyl ether. Removal of the extracting solvent by distillation yields the crude secondary amine derivative. The crude secondary amine derivative can be easily purified by such means as distillation under atmospheric or reduced pressure. The alkaline water layer left after the solvent extraction is neutralized or rendered weakly acidic (pH 2–6), whereupon the corresponding N-substituted alpha-amino acid precipitates. It is isolated by filtration and washing with water. The resulting alpha-amino acid derivative is pure in most cases. If it needs to be further purified, it is recrystallized from a solvent such as alcohol, ethyl acetate, ethyl acetate/n-hexane, or an alcohol/water.

When the organic imine compound of formula (I)-4 is used as the starting material, it is recommended to perform the reaction with the proton donor and to isolate the product by the following procedure after the electrochemical carboxylation.

Specifically, the solvent is removed by distillation after the electrolysis, and water is added to the residue. The uncarboxylated material is removed by extraction with a water-immiscible solvent such as chloroform, benzene or diethyl ether. The alkaline aqueous solution left after the solvent extraction is neutralized or rendered weakly acidic (pH 2–6) whereupon the corresponding N-substituted amino-alpha-amino acid precipitates. It is isolated by filtration. When the electrolysis is carried out at a higher potential, the N-substituted amino-alpha-amino acid is removed in the same way as above, and then the filtrate is passed through a column of an acid-type cation exchange resin, and then eluted with 2 N-ammonia solution. The eluates are evaporated to dryness to isolate the N-unsubstituted alpha-amino acid.

The salt conversion reaction to be optionally performed is a known reaction for the production of an amino acid salt from an amino acid. This reaction may be performed on the free alpha-aminocarboxylic acid isolated in the above manner. Or the salt conversion reaction can be performed simultaneously with the reaction with the proton donor or with the aforesaid post-treatment. The salt conversion reaction can be performed, for example, by passing the alpha-aminocarboxylic acid through a salt-type cation exchange resin. As is well known, alpha-aminocarboxylic acids are amphoteric compounds, and the alpha-amino carboxylic acid salts in accordance with this invention can be obtained as salts with acids or as salts with bases.

The salts between the alpha-aminocarboxylic acids and bases can be produced easily by using as the bases an inorganic substance such as ammonia, sodium hydroxide, potassium hydroxide, sodium carbonate, sodium hydrogen carbonate or calcium hydroxide, or an organic amine such as trimethylamine, methylamine, triethylamine, ethylenediamine, or diethylamine.

The salts between the alpha-aminocarboxylic acids and acids can be produced easily by using as the acids an inorganic acid such as hydrochloric acid, sulfuric acid, phosphoric acid or nitric acid, or an organic sulfonic or carboxylic acid such as toluenesulfonic acid, trichloroacetic acid, trifluoroacetic acid, or trifluoromethanesulfonic acid.

Thus, according to the process of this invention, alpha-aminocarboxylic acids of the general formula

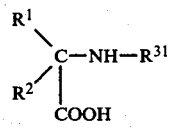

(II)

wherein $R^1$ and $R^2$ are as defined hereinabove; and $R^{31}$ represents a substituted or unsubstituted alkyl, alkenyl or aryl group; or a hydrogen atom or a group of the following formula

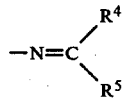

(a')

in which $R^4$ and $R^5$ are identical or different and have the same definitions as $R^1$ and $R^2$ above, when n in $R^3$ of formula (I) given hereinbelow is 0; or a group of the following formula

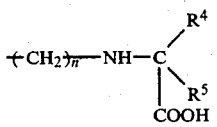

(b)

in which n′ is an integer of at least 2 and $R^4$ and $R^5$ are as defined above, when n is $R^3$ of formula (I) given hereinbelow is an integer of at least 2;

and salts thereof can be obtained from the organic imine compounds of formula (I) and carbon dioxide.

More specifically, alpha-aminocarboxylic acids of the formula

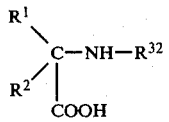

(II)-1 wherein $R^1$, $R^2$ and $R^{32}$ are as defined above with regard to formula (I)-1, and salts thereof are produced from the starting compounds of formula (I)-1.

Alpha-aminocarboxylic acids of the formula

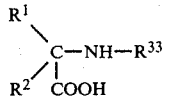

(II)-2 wherein $R^1$, $R^2$ and $R^{33}$ are as defined hereinabove with regard to formula (I)-2, or salts thereof can be obtained from the organic imine compounds of formula (I)-2.

Furthermore, alpha-aminocarboxylic acids of the formula

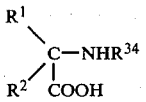

(II)-3 wherein $R^1$, $R^2$ and $R^{34}$ are the same as defined above with regard to formula (I)-3, and salts thereof can be produced from the starting compounds of formula (I)-3.

Likewise, alpha-aminocarboxylic acids of the formula

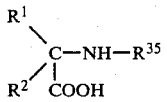

(II)-4 wherein $R^{35}$ represents a hydrogen atom or a group of the formula

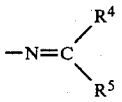

(a′)

in which $R^4$ and $R^5$ are as defined above for (a), and salts thereof can be produced from the starting compounds of formula (I)-4. In other words, according to the process of this invention, alpha-aminocarboxylic acids having a free amino group, and salts thereof can be produced only when using the starting compounds of formula (I)-4.

According to this invention, alpha-aminocarboxylic acids of formula (II)-4 in which $R^{35}$ is hydrogen and alpha-aminocarboxylic acid of formula (II)-4 in which $R^{35}$ is the group of formula (a′) are both produced from the starting compound of formula (I)-4. The alpha-aminocarboxylic acids having a free amino group of formula (II)-4 in which $R^{35}$ is hydrogen, or salts thereof are more readily formed by increasing the potential or voltage when the electrochemical reduction is to be performed by controlled potential or controlled voltage electrolysis, and by increasing the current when the electrochemical reduction is to be performed by a fixed current electrolysis. On the other hand, alpha-aminocarboxylic acids of formula (II)-4 in which $R^{35}$ is the group of formula (a′) tend to be formed more easily as the potential or voltage is reduced, or as the current is reduced.

Investigations of the present inventor have shown that when alpha-aminocarboxylic acids of formula (II)-4 are to be formed from the starting compounds of formula (I)-4, alpha-aminocarboxylic acids of the formula

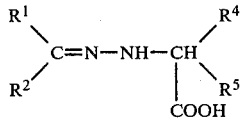

or salts thereof are also formed. The process of this invention embraces a method for producing such compounds, as is clear from the fact that $R^4$, $R^5$ and $R^1$, $R^2$ in formula (II)-4 may be read for $R^1$, $R^2$ and $R^4$ and $R^5$ in formula (I)-4.

Investigations of the present inventor also indicate that the N-substituted amino-alpha-amino acid [(II)-4; $R^{35}$=(a′)] obtained by the electrochemical carboxylation of azine derivatives [(I)-4], can be generally transformed into N-unsubstituted alpha-amino acid in good yield, as described in Examples 20 and 21, for N-benzylideneaminophenylglycine and N-(α′-methylbenzylideneamino)-alpha-phenylalanine, respectively.

From the starting compounds of formula (I)-5, there can be produced alpha-aminocarboxylic acids containing two alpha-carboxyl groups having the following formula

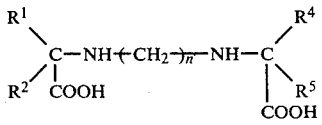

(II)-5 wherein all symbols are the same as defined in formula (I)-5, and salts thereof.

The following Examples illustrate the process of this invention in greater detail. It should be noted however that the present invention is not limited to these specific examples.

EXAMPLE 1

Benzylidene aniline (1.00 g), tetraethylammonium iodide (1.0 g), and anhydrous acetonitrile (100 ml) were placed into a cathode chamber of an H-type cell partitioned with an ion exchange membrane ("NAFION 425", a trademark for a product of E. I. du Pont de Nemours & Co.). Then tetraethylammonium iodide (5.0 g) and acetonitrile (70 ml) were placed in an anode chamber of the cell. A brass electrode (4×8 cm, thickness 2 mm) as a cathode and a platinum cylinder (6×8 cm, thickness 0.2 mm) as an anode were used. A current was passed in an amount of 1940 coulombs while always blowing carbon dioxide gas with magnetic stirring and while maintaining the cathode potential at −1.85 V with respect to a saturated calomel electrode. At the beginning, the current was 50 mA, and at the end, 0.3 mA.

After the electrolysis, the catholyte solution was transferred into an eggplant-shaped flask, and the acetonitrile was distilled off. Water (20 ml) was added to the residue. First, using 100 ml of benzene, materials (mainly by-product, secondary amines) soluble in benzene were removed. By carefully acidifying the remaining aqueous solution with hydrochloric acid, 1.07 g of a white precipitate was obtained. Recrystallization from methanol afforded white crystals having a melting point of 190° to 191° C. (decomp.).

In the infrared absorption spectrum, a broad absorption based on amino acid

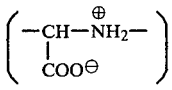

appeared at 2850–2200 $cm^{-1}$.

In the mass spectrum, m/e 227 (intensity 20%, $M^+$), and 182 (100%,

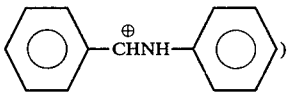

were observed.

In the proton magnetic resonance spectrum (in $d_6$-dimethyl sulfoxide, δppm, tetramethylsilane), absorption existed at 5.07

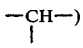

and 6.78–7.60 (m, 10H, aromatic proton).

The elemental analysis values found were H 5.83%, C 74.12%, N 6.16%, which well corresponded with the calculated values for $C_{14}H_{13}NO_2$ (227.25), i.e. H 5.76%, C 73.99%, N 6.17%.

From the above results, it was clear that the white crystals obtained by acidification with hydrochloric acid were N,2-diphenylglycine. The yield was 85.1% based on the used benzylidene aniline. Identification of the product as N,2-diphenylglycine was also made by comparing the spectral data of the product with those of an authentic sample synthesized alternatively in known manner as will be described below in the following Referential Example.

Referential Example (Synthesis of N,2-diphenylglycine)

Alpha-anilinophenylacetonitrile was synthesized by the cyanohydrin method (E. Miiller, "Methoden der Organischen Chemie", IV/III p. 283 (1958)). It was hydrolyzed with alkali (in accordance with S. Sarel, A. Greenberger, J. Org. Chem., 330 (1958)).

Specifically, conc. hydrochloric acid was added to aniline, and the hydrochloride was separated by filtration and dried. A 50 ml flask was charged with 4.31 g of benzaldehyde, 8 ml of diethyl ether, and 2.50 g of potassium cyanide, and with magnetic stirring, 4.99 g of the aniline hydrochloride was added. After stirring for one hour, water was added to dissolve the materials entirely. The solution was stirred further for 20 minutes. The ethereal layer was separated, and the aqueous layer was extracted with diethyl ether. The two ethereal layers were combined, and dried over anhydrous sodium sulfate. Distilling off of the ether gave 7.95 g of crude alpha-anilinophenylacetonitrile having a melting point of 83° to 84° C.

Infrared absorption spectrum

2220 $cm^{-1}$ (C═N)

Mass spectrum (20 eV) 208 (intensity 1%, $M^+$), 181 (100%, $M^+$—HCN)

Elemental analysis values

For $C_{14}H_{12}N_2$(208.26)

Found: H 5.69%, C 80.01%, N 13.19%; Calculated: H 5.81%, C 80.74%, N 13.45%.

The alpha-anilinophenylacetonitrile (0.98 g) was added to 1 N-NaOH (20 ml), and the mixture was heated for 4 hours under stirring. The resulting oily product was removed by extraction with benzene. The aqueous layer was carefully acidified with hydrochloric acid to afford 74 g (yield 6.9%) of N,2-diphenylglycine as a white solid. The elemental analysis values of the product were H 5.75%, C 73.89% and N 6.20%, which well correspond to the theoretical values for $C_{14}H_{13}NO_2$, i.e. H 5.77%, C 73.99%, N 6.16%. The infrared absorption spectrum, mass spectrum and proton magnetic resonance spectrum of the product were completely identical with those of the product obtained from benzylidene aniline by the process of this invention.

When alpha-anilinophenylglycine was hydrolyzed with 20% hydrochloric acid, a tarry material was formed in large amounts, and N,2-diphenylglycine was not obtained.

EXAMPLE 2

The electrochemical reduction was performed at −1.90 V in substantially the same manner as in Example 1 except that 16 ml of purified mercury was used as the cathode instead of brass. After the electrolysis, the catholyte was similarly treated to obtain 0.485 g (yield 38.7%) of N,2-diphenylglycine from 1.00 g of benzylidene aniline.

EXAMPLE 3

A current was passed for 5.0 hours (1117 coulombs) under similar conditions as in Example 1 except that the electrolyzing current was adjusted to 50 mA per 1.00 g of benzylidene aniline. The electrolyzed solution was treated in the same way as in Example 1 to afford N,2-diphenylglycine in a yield of 87.2%.

When the same electrolysis was performed while adjusting the electrolyzing current to 20 mA per 1.00 g of benzylidene aniline, N,2-diphenylglycine was obtained in a yield of 60.4%.

EXAMPLE 4

Benzylidene aniline (1.00 g) was electrochemically reduced at a controlled potential in substantially the same way as in Example 1 except that instead of the brass cathode, each of the various solid metal electrodes having much the same area was used. The main electrolyzing conditions and the yields of N,2-diphenylglycine are shown in Table 1.

Table 1

| No. | Electrode | Set potential ($V_{vs}$ SCE) | Amount of electricity (coulombs) | N,2-diphenylglycine Yield (g) | N,2-diphenylglycine Yield (%) |
|---|---|---|---|---|---|
| 1 | Graphite | −1.75 | 1770 | 0.873 | 69.7 |
| 2 | Inconel | −2.00 | 2510 | 0.854 | 68.1 |
| 3 | Copper | −1.95 | 2470 | 0.852 | 68.0 |
| 4 | Nichrome | −1.80 | 1440 | 0.842 | 67.2 |
| 5 | Zinc | −1.90 | 1780 | 0.780 | 62.2 |
| 6 | Lead | −1.70 | 1570 | 0.602 | 48.0 |
| 7 | Platinum | −1.95 | 1130 | 0.594 | 47.4 |
| 8 | Nickel | −2.00 | 1680 | 0.563 | 44.9 |
| 9 | Stainless steel | −2.00 | 1470 | 0.520 | 41.5 |
| 10 | Aluminum | −3.00 | 1920 | 0.510 | 40.7 |

EXAMPLE 5

Electrolysis was performed for 2.5 hours for 1.20 g of dibenzylidene ethylenediamine under similar conditions as used in Example 1 except that a controlled current electrolytic method (current 215 mA) was used. The electrolyzed solution was treated in the same way as in Example 1 to afford N,N'-bis-N-(alpha-carboxyl-benzyl)ethylenediamine $$(C_6H_5\underset{\underset{COOH}{|}}{C}HNHCH_2CH_2NH\underset{\underset{COOH}{|}}{C}HC_6H_5)$$

having a sublimation point of 295° to 300° C. The yield was 79.3%.

EXAMPLE 6

Each of the various Schiff bases shown in Table 2 was used instead of benzylidene aniline in Example 1, and was electrolyzed at controlled currents using various solid electrodes. The results are shown in Table 2.

Table 2

| Run No. | Schiff base (weight, used) | Cathode | Electric current (quantity of electricity) | Amino acid (yield) |
|---|---|---|---|---|
| 1 | Benzylidene o-toluidine (1.22 g) | Brass | 53 mA (2100 coulomb) | N-(o-Tolyl)-phenylglycine (78.9%) |
| 2 | Benzylidene m-toluidine (1.23 g) | Brass | 76 mA (1980 coulomb) | N-(m-Tolyl)-phenylglycine (82.4%) |
| 3 | Benzylidene p-toluidine (1.22 g) | Brass | 47 mA (1640 coulomb) | N-(p-Tolyl)-phenylglycine (80.8%) |
| 4 | 2-Chlorobenzylidene aniline (1.29 g) | Brass | 57 mA (1200 coulomb) | N-phenyl-(2-chloro)-phenylglycine (45.5%) |
| 5 | Benzylidene-(2-ethoxy-carbonyl)-aniline (1.20 g) | Copper | 53 mA (1170 coulomb) | N-(2-Ethoxycarbonylphenyl)-phenylglycine (79.9%) |
| 6 | Benzylidene-(3-oxy-carbonyl)-aniline (1.20 g) | Copper | 55 mA (1490 coulomb) | N-(3-Oxycarbonylphenyl)-phenyl-glycine (68.1%) |
| 7 | 4-Methoxybenzylidene aniline (1.20 g) | Brass | 60 mA (1820 coulomb) | N-Phenyl-(4-methoxy)-phenyl-glycine (81.6%) |
| 8 | 3-Carboethoxybenzylidene-(4-bromo)-aniline (1.10 g) | Graphite | 50 mA (1320 coulomb) | N-(p-Bromo)-phenyl-(3-ethoxy-carbonyl)-phenylglycine (60.1%) |
| 9 | Benzylidene p-diphenyl-amine (1.19 g) | Platinum | 37 mA (1050 coulomb) | N-(p-Diphenyl)-phenylglycine (80.5%) |
| 10 | n-Butylidene aniline (1.00 g) | Platinum | 80 mA (3200 coulomb) | α-Anilinobutyric acid (34.2%) |
| 11 | Cyclohexylidene p-toluidine (1.33 g) | Platinum | 48 mA (2990 coulomb) | 1-(p-Tolylamino)-cyclohexyl-carboxylic acid (29.7%) |
| 12 | N-(α-Methyl)-benzylidene p-toluidine (1.74 g) | Platinum | 41 mA (2800 coulomb) | N-(p-Tolyl)-α-phenyl-α-alanine (76.6%) |
| 13 | 3-Hydroxybenzylidene p-toluidine (1.00 g) | Zinc | 42 mA (1800 coulomb) | N-Tolyl-(3-hydroxy)-phenylglycine (49.8%) |
| 14 | Benzylidene (p-ethylthio)-aniline (1.20 g) | Nicrom | 65 mA (1970 coulomb) | N-(p-Ethylthiophenyl)-phenyl-glycine (51.0%) |
| 15 | 4-Dimethylaminobenzylidene aniline | Graphite | 42 mA (1910 coulomb) | N-Phenyl-(4-dimethylamino)-phenylglycine |

Table 2-continued

| Run No. | Schiff base (weight, used) | Cathode | Electric current (quantity of electricity) | Amino acid (yield) |
|---|---|---|---|---|
| | (1.54 g) | | | (44.4%) |

EXAMPLE 7

Various Schiff bases were electrolyzed under similar conditions as in Example 2 except that a controlled current electrolytic method was used. The results are summarized in Table 3.

Table 3

| Run No. | Schiff base (weight, used) | Electric current (quantity of electricity) | Amino acid (yield) |
|---|---|---|---|
| 1 | Benzylidene p-toluidine (1.06 g) | 77.5 mA (1160 coulomb) | N-(p-Tolyl)-phenylglycine (31.6%) |
| 2 | Benzylidene m-toluidine (1.23 g) | 70 mA (1320 coulomb) | N-(m-Tolyl)-phenylglycine (23.4%) |
| 3 | Benzylidene o-toluidine (1.20 g) | 45 mA (1305 coulomb) | N-(o-Tolyl)-phenylglycine (35.3%) |
| 4 | 4-(Methyl)-benzylidene aniline (1.20 g) | 74 mA (1240 coulomb) | N-Phenyl-(4-methyl)-phenylglycine (56.3%) |
| 5 | Benzylidene p-chloroaniline (1.20 g) | 55 mA (1330 coulomb) | N-(p-Chlorophenyl)-phenylglycine (73.2%) |
| 6 | 4-Chlorobenzylidene aniline (1.20 g) | 48 mA (1090 coulomb) | N-Phenyl-(4-chloro)-phenylglycine (70.9%) |
| 7 | 4-Methylbenzylidene p-chloro-aniline (1.20 g) | 45 mA (1200 coulomb) | N-(p-Chlorophenyl)-(4-methyl)-phenylglycine (70.8%) |
| 8 | Benzylidene p-bromoaniline (1.20 g) | 48 mA (1070 coulomb) | N-(p-Bromophenyl)-phenylglycine (85.3%) |
| 9 | Benzylidene p-phenylaniline (1.19 g) | 37 mA (1020 coulomb) | N-(p-diphenyl)-phenylglycine (74.2%) |
| 10 | Benzylidene o-phenylaniline (1.50 g) | 39.5 mA (1230 coulomb) | N-(o-diphenyl)-phenylglycine (84.5%) |
| 11 | Benzylidene (p-ethoxycarbonyl)-aniline (1.20 g) | 41 mA (1240 coulomb) | N-(p-Ethoxycarbonylphenyl)-phenyl-glycine (81.2%) |
| 12 | Benzylidene (o-ethoxycarbonyl)-aniline (1.20 g) | 53 mA (1180 coulomb) | N-(o-Ethoxycarbonylphenyl)-phenyl-glycine (61.5%) |
| 13 | Benzylidene (p-methoxy)-aniline (1.20 g) | 58 mA (1310 coulomb) | N-(p-Methoxyphenyl)-phenylglycine (66.7%) |
| 14 | 4-(Methoxy)-benzylidene aniline (1.20 g) | 60 mA (1870 coulomb) | N-Phenyl-(4-methoxy)-phenylglycine (59.5%) |
| 15 | Benzylidene (m-oxycarbonyl)-aniline (1.20 g) | 55 mA (1490 coulomb) | N-(m-Oxycarbonylphenyl)-phenylglycine (40.3%) |
| 16 | Dibenzylidene ethylenediamine (1.20 g) | 73 mA (1980 coulomb) | bis-N-(α-Carboxybenzyl)-ethylene-diamine (41.4%) |

EXAMPLE 8

In the same way as in Example 1, 1.21 g of benzylidene laurylamine was electrolyzed by passing a current for 2.6 hours at an average current value of 215 mA. As a result, 0.35 g of a white precipitate was formed. The white precipitate was separated by filtration, and acetonitrile was distilled off. Water was added to the residue to afford 0.89 g of a white precipitate. The product shows an absorption based on amino acid $$\left(-\underset{\underset{COO^{\ominus}}{|}}{\overset{\oplus}{C}}HNH_2-\right)$$

at 3220–2500 $cm^{-1}$ in the infrared absorption spectrum, and a peak corresponding to $M^+—CO_2$ at m/e 275 in the mass spectrum. The elemental analysis values corresponded to the composition formula $C_{20}H_{33}NO_2$ (319.47). Thus, the product was identified as N-lauryl-2-phenylglycine. The yield was 63.5%.

EXAMPLE 9

In the same way as in Example 2, 1.08 g of benzylidene(n)-butylamine was electrolyzed by passing a constant current for 3.1 hours (1715 coulombs) using a brass electrode. After the electrolysis, the catholyte was separated from mercury, and acetonitrile was distilled off. Water (15 ml) was added to the residue, and the mixture was extracted with 200 ml of chloroform.

When the aqueous solution left after the chloroform extraction, was acidified with hydrochloric acid, 0.50 g of a white precipitate was obtained. Recrystallization from 50% aqueous ethanol solution afforded white crystals having a sublimation point of 243° to 249° C. The product showed an absorption based on amino acid $$\left(-\underset{\underset{COO^{\ominus}}{|}}{\overset{\oplus}{C}}HNH_2-\right)$$

at 3200–2100 $cm^{-1}$ in the infrared absorption spectrum, and a peak based on $M^+—COOH$ at m/e 162 (intensity 100%) in the mass spectrum. The elemental analysis values found were H 8.45%, C 69.85%, N 6.61%, which well corresponded with the calculated values for the composition formula $C_{12}H_{17}NO_2$ (207.27), i.e. H 8.27%, C 69.54%, N 6.76%. The proton magnetic resonance spectrum (tetramethylsilane) of the product measured in trifluoroacetic acid showed signals of $CH_3$ proton of triplet at δ1.00, three $CH_2$ protons at δ1.46, 1.82 and 3.72, and proton of $NH_2^+$ at δ5.70, and five aromatic protons at δ7.50.

From the above results, it was clear that the white crystals obtained by acidification with hydrochloric acid were N-(n-)butyl-2-phenylglycine. The yield of the product was 55.2% based on the used benzylidene-(n-)butylamine.

EXAMPLE 10

In the same way as in Example 1, 1.83 g of p-chlorobenzylidene-n-butylamine was electrolyzed for 5.9 hours at an average current of 85 mA. By treating the electrolytic solution, 0.94 g (yield 39.5%) of N-n-butyl-2-p-chlorophenylglycine was obtained.

EXAMPLE 11

Under substantially the same conditions as in Example 1, 1.50 g of benzylidene beta-phenethylamine was electrolyzed at 63 mA for 5.5 hours. By treating the electrolyzed solution in the same way as in Example 1, 0.82 g (yield 44.6%) of N-(beta-phenethyl)-2-phenylglycine was obtained.

EXAMPLE 12

In the same way as in Example 1, 1.02 g of benzylidene cyclohexylamine was electrolyzed at an average current of 35 mA for 9.2 hours (1153 coulombs). Water (20 ml) and 200 ml of benzene were added to the catholyte, whereupon 0.73 g of a white solid was precipitated. Recrystallization of the solid from a large amount of 50% aqueous ethanol solution afforded white crystals having a sublimation point of 250° to 270° C.

The product showed an absorption based on amino acid $$\left(-\underset{\underset{COO^{\ominus}}{|}}{\overset{\oplus}{C}}HNH_2-\right)$$

at 3200–2000 $cm^{-1}$ in the infrared absorption spectrum, and a molecular ion peak at m/e 233 in the mass spectrum. The results of elemental analysis corresponded with the composition on formula $C_{14}H_{19}NO_2$ (233.30). From the above results, it was clear that the product was N-cyclohexyl-2-phenylglycine. The yield was 57.4%.

EXAMPLE 13

Benzylidene 2-methylcyclopentylamine (1.3 g) was electrolyzed for 6.1 hours at an average current of 75 mA in the same way as in Example 1 except that tetra-n-heptylammonium sulfate was used as an electrolyte. By treating the electrolyzed solution, 0.83 g (yield 48.1%) of N-(2-methylcyclopentyl)-2-phenylglycine was obtained.

EXAMPLE 14

In the same way as in Example 1, 2.00 g of m-oxycarbonyl benzylidene n-hexylamine was electrolyzed for 6.2 hours at an average current of 95 mA. By treating the electrolyzed solution with formic acid, 1.10 g (yield 46.3%) of N-n-hexyl-2-(m-oxycarbonyl)phenylglycine was obtained.

EXAMPLE 15

Example 1 was repeated except that each of the various Schiff bases shown in Table 4 was used instead of benzylidene aniline. The electrodes and the current values were changed as shown in Table 4. The results are also shown in Table 4.

Table 4

| Run No. | Schiff base (weight, used) | Cathode | Electric current (quantity of electricity) | Amino acid (yield) |
|---|---|---|---|---|
| 1 | Benzylidene cyclohexylamine (1.10 g) | Brass | 40 mA (1310 coulomb) | (N-Cyclohexyl)-phenylglycine (75.9%) |
| 2 | Benzylidene laurylamine (1.21 g) | Brass | 50 mA (780 coulomb) | N-Lauryl-phenylglycine (83.5%) |
| 3 | Benzylidene (3-methyl)-cyclopentylamine (1.55 g) | Copper | 68 mA (2000 coulomb) | N-(3-Methylcyclopentyl)-phenylglycine (58.6%) |
| 4 | N-4-(2,6-Dimethyl)-heptylidene n-butylamine (1.77 g) | Platinum | 85 mA (3010 coulomb) | N-(n-Butyl)-diisobutyl-glycine (39.5%) |
| 5 | 4-(Methyl)-benzylidene allylamine (1.03 g) | Zinc | 40 mA (1100 coulomb) | N-(Allyl)-phenylglycine (40.8%) |
| 6 | Benzylidene benzylamine (1.79 g) | Brass | 40 mA (2830 coulomb) | N-Benzyl-phenylglycine (34.4%) |

EXAMPLE 16

Benzalazine (2.00 g) was electrolyzed using a mercury (12 ml, 20 $m^2$) cathode and a platinum cylinder (thickness 2 mm, 32 $cm^2$) anode. A current in an amount of 2080 coulombs was passed while maintaining the cathode potential at −1.9 V with respect to a saturated calomel electrode, and while blowing carbon dioxide gas always with magnetic stirring. At this time, the current value was 46 mA at the beginning, and 3 mA at the end. After the electrolysis, the catholyte was transferred to an eggplant-shaped flask, and acetonitrile was distilled off. Water (20 mg) was added to the residue. First, 200 ml of benzene was added to extract benzene-soluble materials. The benzene extract gradually turned yellow. On distillation, 0.98 g of benzalazine with some impurities was recovered.

The remaining alkaline aqueous solution left after the benzene extraction was carefully acidified with hydrochloric acid, whereupon 0.98 g of a white solid was obtained. Recrystallization from ethanol afforded white crystals having a melting point of 164° to 165° C. (decomp.). The product showed an absorption based on NH at 3210 $cm^{-1}$, an absorption based on amino acid

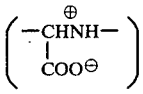

at 3080–2130 $cm^{-1}$, an absorption based on C=O at 1705 $cm^{-1}$, and an absorption based on C=N at 1608 $cm^{-1}$ in the infrared absorption spectrum. The m/e (intensity %) value of the peaks in the mass spectrum measured at 20 eV, and the results of analysis of the fragments were as follows:

m/e; 254 (10.5%, $M^{\oplus}$), 210 (34%, $M^{\oplus}$—$CO_2$), 209 (100%, $M^{\oplus}$—COOH), 131 (20%,

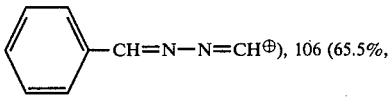

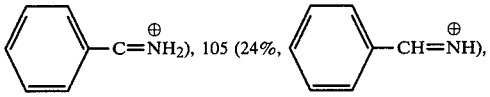

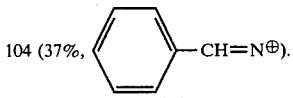

The chemical shifts (δ, tetramethyl silane) of the proton magnetic resonance spectrum of the product measured in deutero-dimethylsulfoxide and the results of analysis of the signals were as follows:

5.13 (singlet, 1H,

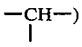

7.2–7.6 (multiplet, 10H, aromatic proton), 7.88 (singlet, 1H, —C<u>H</u>=N—)

The elemental analysis values were H 5.44%, C 70.49%, N 10.85%, which well corresponded with the calculated values for $C_{15}H_{14}N_2O_2$ (254.28), i.e. H 5.55%, C 70.85%, N 11.02%.

From the above results it was clear that the white crystals obtained by acidification with hydrochloric acid were N-benzylideneamino-2-phenylglycine. The yield was 40.1% based on the benzalazine used. The corrected yield calculated in consideration of benzalazine recovered by benzene extraction was 78.7%.

EXAMPLE 17

Benzalazine (1.20 g) was electrolyzed by passing a current in an amount of 1170 coulombs while maintaining the cathode potential at −2.0 V with respect to a saturated calomel electrode. At this time, the current value was 60 mA at the beginning, and 5 mA at the end. Acetonitrile was distilled off from the electrolyzed solution, and water was added to the residue. The mixture was extracted with benzene, whereby 0.47 g of benzalazine with some impurities was recovered. The aqueous solution left after the benzene extraction was acidified with hydrochloric acid to afford 0.46 g of N-benzylideneamino-2-phenylglycine in a yield of 31.1% (the corrected yield 51.4% calculated in consideration of the recovered benzalazine).

The remaining aqueous solution left after the separation of N-benzylideneamino-2-phenylglycine was passed through a column of an acid-type cation exchange resin (Dowex 50 W-X8, 2.4 $\phi \times 30$ cm), and eluted with 400 ml of 2 N ammonia solution. The eluates were dried to solidification to afford 0.24 g of a pale yellow solid. Recrystallization from water afforded white crystals having a sublimation point of 240° C.

In an infrared absorption spectrum, the product showed an absorption ascribable to amino acid

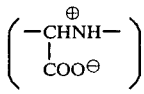

at 3100–2600 $cm^{-1}$, and an absorption ascribable to a carboxyl anion (—$COO^-$) at 1680–1550 $cm^{-1}$. The elemental analysis values were H 5.98%, C 63.96%, N 9.31%, which well corresponded with the calculated values for $C_8H_9NO_2$ (151.16), i.e. H 6.00%, C 63.56%, N 9.27%.

It is clear from the above results that the white crystals obtained by passing through a column of a cation exchange resin were phenylglycine. The yield was 13.8% based on the used benzalazine. The corrected yield calculated in consideration for the benzalazine recovered by the benzene extraction was 22.8%.

EXAMPLE 18

1.20 g of benzalazine was electrolyzed by passing an electric current in an amount of 1500 coulombs while maintaining the cathode potential at −2.1 V with respect to a saturated calomel electrode. The electrolyzed solution was treated in quite the same way as in Example 16, to recover 0.48 g of benzalazine with some impurities. Thus, 0.20 g (yield 13.8%; corrected yield 24.9%) of N-benzylideneamino-2-phenylglycine and 0.37 g (yield 21.0%; corrected yield 35.2%) of phenylglycine were obtained.

EXAMPLE 19

Example 16 was repeated except that each of the azines shown in Table 5 was used instead of benzalazine. The electrolyzing conditions shown in Table 5 were used. The results are summarized in Table 5.

Table 5
| Run No. | Azine (weight, used) | Amino acid: N-substituted | Amino acid: N-unsubstituted |
|---|---|---|---|
| 1 | 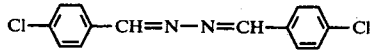 (1.00 g) | 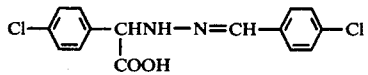 | 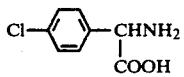 |
| 2 | 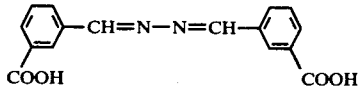 (1.05 g) | 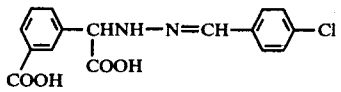 | 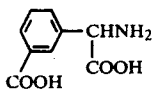 |
| 3 | 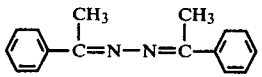 (1.20 g) | 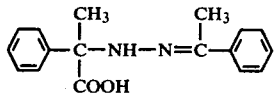 | 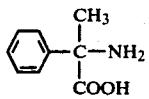 |
| 4 | 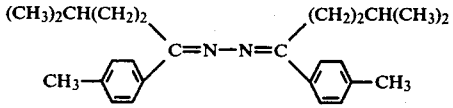 (1.20 g) | 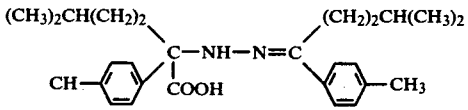 | 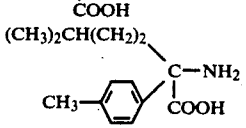 |
| 5 | 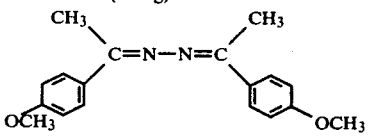 (1.20 g) | 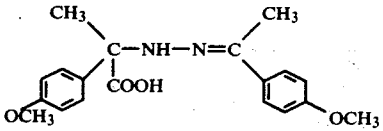 | 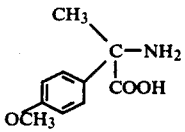 |
| 6 | 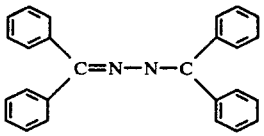 (1.50 g) | 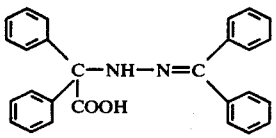 | 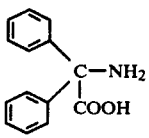 |
| 7 | 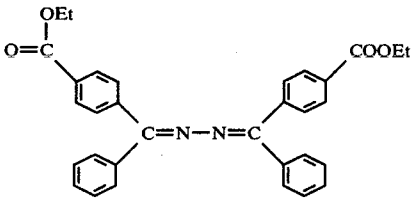 (1.10 g) | 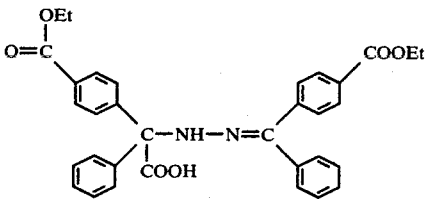 | 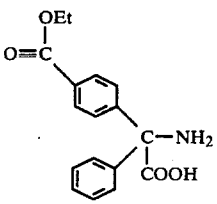 |
| 8 | $n\text{-}C_6H_{13}CH{=}N{-}N{=}CH{-}CH\text{-}n\text{-}C_6H_{13}$ (3.20 g) | $n\text{-}C_6H_{13}CH(COOH)NH{-}N{=}C\text{-}n\text{-}C_6H_{13}$ | $n\text{-}C_6H_{13}CH(COOH)NH_2$ |

Table 5-continued

| | | | | | |
|---|---|---|---|---|---|
| 9 | $n\text{-}C_4H_9-C(CH_3)=N-N=C(CH_3)-n\text{-}C_4H_9$ (1.42 g) | $n\text{-}C_4H_9-C(COOH)(CH_3)-NH-N=C(CH_3)-n\text{-}C_4H_9$ | | | $n\text{-}C_4H_9-C(COOH)(CH_3)-NH_2$ |
| | | Run No. | Set Potential vs SCE (quantity of electricity) | Yield of amino acid: N-substituted | Yield of amino acid: N-unsubstituted | Solvent and cathode |
| | | 1 | −1.85 V (1030 coulomb) | 0.45 g | 0 | Acetonitrile, mercury |
| | | | −2.10 V (3080 coulomb) | 0.10 g | 0.39 g | |
| | | 2 | −1.90 V (1770 coulomb) | 0.38 g | 0 | Acetonitrile, mercury |
| | | | −2.20 V (4500 coulomb) | 0.09 g | 0.38 g | |
| | | 3 | −1.95 V (2560 coulomb) | 0.20 g | 0 | Acetonitrile, mercury |
| | | | −2.20 V (4320 coulomb) | 0.17 g | 0.54 g | |
| | | 4 | −1.95 V (1100 coulomb) | 0.41 g | 0 | Acetonitrile, mercury |
| | | | −2.00 V (3710 coulomb) | 0.24 g | 0.30 g | |
| | | 5 | −2.00 V (1600 coulomb) | 0.33 g | 0 | N,N-Dimethylformamide, |
| | | | −2.30 V (4000 coulomb) | 0 | 0.37 g | brass |
| | | 6 | −1.80 V (1380 coulomb) | 0.50 g | 0 | Acetonitrile, mercury |
| | | | −2.10 V (4170 coulomb) | 0.11 g | 0.51 g | |
| | | 7 | −1.75 V (1350 coulomb) | 0.42 g | 0 | Acetonitrile, graphite |
| | | | −2.10 V (3900 coulomb) | 0.18 g | 0.33 g | |
| | | 8 | −2.25 V (5210 coulomb) | 0.40 g | 0.93 g | Acetonitrile, copper |
| | | 9 | −2.27 V (3150 coulomb) | 0.23 g | 0.47 g | Acetonitrile, graphite |

EXAMPLE 20

The composition of an electrolytic solution was the same as in Example 16 except that 0.50 g of N-benzylideneamino-2-phenylglycine was used instead of benzalazine. While the cathode potential was maintained at −1.5 to −1.8 V with respect to a saturated calomel electrode, an electric current was passed in an amount of 260 coulombs. Then, the cathode potential was adjusted to −2.1 V, and a current was further passed in an amount of 1560 coulombs. The catholyte was treated in the same way as in Example 18 to obtain 0.19 g of phenylglycine in a yield of 63.3%.

EXAMPLE 21

In the same way as in Example 16, 0.35 g of N-(α'-methylbenzylideneamino)-alpha-phenylalanine was electrolyzed at −2.2 V. As a result, 0.25 g of alpha-phenylalanine was obtained.

What we claim is:

1. A process for producing alpha-aminocarboxylic acids of the following formula

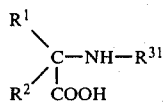

(II)

wherein $R^1$ and $R^2$ are the same or different, and represent a hydrogen atom, or a substituted or unsubstituted alkyl, alkenyl or aryl group, and $R^1$ and $R^2$ do not represent hydrogen atoms at the same time, $R^{31}$ represents a substituted or unsubstituted alkyl, alkenyl or aryl group; or a hydrogen atom or a group of the following formula

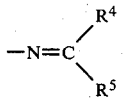

(a')

in which $R^4$ and $R^5$ are identical or different and have the same definitions as $R^1$ and $R^2$ above, when n in $R^3$ of formula (I) given hereinbelow is 0; or a group of the following formula

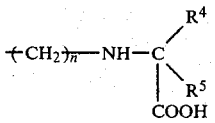

(b)

in which n' is an integer of at least 2 and $R^4$ and $R^5$ are as defined above, when n in $R^3$ of formula (I) given hereinbelow is an integer of at least 2;

or salts thereof which comprises subjecting an organic imine compound of the following formula

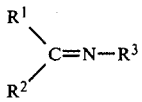

(I)

wherein $R^1$ and $R^2$ are as defined above, and $R^3$ represents a substituted or unsubstituted alkyl, alkenyl or aryl group, or a group of the following formula

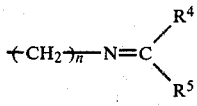

(a)

in which $R^4$ and $R^5$ are identical or different, and have the same definitions as $R^1$ and $R^2$, and n is 0 or an integer of at least 2, and carbon dioxide to electrochemical reduction and addition reaction in an aprotic polar organic medium in the substantial absence of water, and thereafter reacting the resulting active carboxylated anion species with a proton donor.

2. The process of claim 1 wherein an alpha-aminocarboxylic acid of the formula

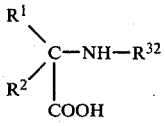

(II)-1 wherein $R^1$ and $R^2$ are as defined for formula (I), and $R^{32}$ represents a substituted or unsubstituted alkyl group, or a salt thereof is produced from an organic imine compound of the formula

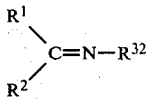

(I)-1 wherein all symbols are the same as defined above, and carbon dioxide.

3. The process of claim 1 wherein an alpha-aminocarboxylic acid of the formula

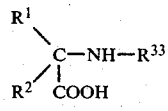

(II)-2 wherein $R^1$ and $R^2$ are as defined in formula (I), and $R^{33}$ represents a substituted or unsubstituted alkenyl group, or a salt thereof is produced from an organic imine compound of the formula

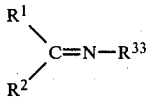

(I)-2 wherein all symbols are as defined above, and carbon dioxide.

4. The process of claim 1 wherein an alpha-aminocarboxylic acid of the formula

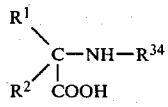

(II)-3 wherein $R^1$ and $R^2$ are the same as defined in formula (I), and $R^{34}$ represents a substituted or unsubstituted aryl group, or a salt thereof is produced from an organic imine compound of the formula

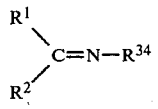

(I)-3 wherein all symbols are as defined above, and carbon dioxide.

5. The process of claim 1 wherein an alpha-aminocarboxylic acid of the formula

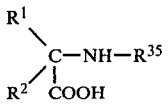

(II)-4 wherein $R^1$ and $R^2$ are the same as defined in formula (I), and $R^{35}$ represents a hydrogen atom or a group of the formula

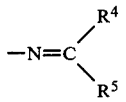

(a')

in which $R^4$ and $R^5$ are as defined in formula (I), or a salt thereof is produced from an organic imine compound of the formula

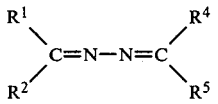

(I)-4 wherein all symbols are as defined in formula (I), and carbon dioxide.

6. The process of claim 1 wherein an alpha-aminocarboxylic acid of the formula

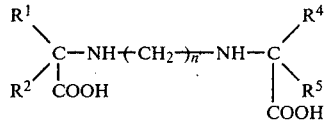

(II)-5 wherein n' is an integer of at least 2, and all other symbols are the same as defined in formula (I), or a salt thereof is produced from an organic imine compound of the formula

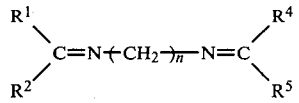

(I)-5 wherein all symbols are as defined above, and carbon dioxide.

7. The process of any one of claims 1 to 6 wherein at least one of $R^1$ and $R^2$ represents a substituted or unsubstituted aryl group.

8. The process of claim 1 wherein the electrochemical reduction and the addition reaction are performed on an organic imine compound and carbon dioxide in the aprotic polar organic medium.

9. The process of claim 1 wherein the electrochemical reduction is carried out using a solid cathode.

10. The process of claim 1 wherein the electrochemical reduction is carried out in the presence of a tetraalkyl ammonium salt of the formula $$(R^6)_4N^{\oplus}.X^{\ominus}$$

wherein $R^6$ represents an alkyl group containing 1 to 6 carbon atoms and X represents an anion.

11. The process of claim 1 wherein the proton donor is water.

12. The process of any one of claims 1 to 6 which further comprises subjecting the product resulting from the reaction of the active carboxylated anion species with the proton donor to a salt conversion reaction.

* * * * *